US012364913B2

(12) United States Patent
Ecker

(10) Patent No.: US 12,364,913 B2
(45) Date of Patent: Jul. 22, 2025

(54) TRAINING BAT

(71) Applicant: Donald Ecker, Dallas, TX (US)

(72) Inventor: Donald Ecker, Dallas, TX (US)

( * ) Notice: Subject to any disclaimer, the term of this patent is extended or adjusted under 35 U.S.C. 154(b) by 268 days.

(21) Appl. No.: 17/963,513

(22) Filed: Oct. 11, 2022

(65) Prior Publication Data

US 2023/0112946 A1 Apr. 13, 2023

Related U.S. Application Data

(60) Provisional application No. 63/254,771, filed on Oct. 12, 2021.

(51) Int. Cl.
*A63B 69/00* (2006.01)
*A63B 102/18* (2015.01)

(52) U.S. Cl.
CPC .. *A63B 69/0002* (2013.01); *A63B 2069/0008* (2013.01); *A63B 2102/18* (2015.10); *A63B 2102/182* (2015.10); *A63B 2208/12* (2013.01); *A63B 2214/00* (2020.08)

(58) Field of Classification Search
CPC ..... A63B 69/0002; A63B 2069/0008; A63B 2102/18; A63B 2102/182
USPC ..... 473/457
See application file for complete search history.

(56) References Cited

U.S. PATENT DOCUMENTS 1,706,680 A 3/1929 Smith
3,554,545 A 1/1971 Mann et al.
3,861,682 A 1/1975 Fujii
4,940,247 A 7/1990 Magadini
D325,612 S 4/1992 Longo
5,833,561 A * 11/1998 Kennedy ..... A63B 59/50 473/566
5,897,448 A * 4/1999 Chang ..... A63B 49/08 473/568
5,944,617 A * 8/1999 Falone ..... A63B 60/06 473/549
6,319,157 B1 * 11/2001 Broadbent ..... A63B 69/002 473/457
6,918,843 B1 7/2005 Franssen
(Continued)

FOREIGN PATENT DOCUMENTS

DE 29513466 U1 10/1995
JP 2007167604 A 7/2007

OTHER PUBLICATIONS

Camwood Hands-n-Speed Weighted Training Bat, http://www.hittingworld.com/ > All Training Aids (https://www.hittingworld.com/baseball-practice-training-aids-s/1.htm), 4 pages.
(Continued)

*Primary Examiner* — Mitra Aryanpour
(74) *Attorney, Agent, or Firm* — Stinson LLP

(57) ABSTRACT

A training bat for optimizing the swing of a hitter includes a barrel portion and a handle portion connected to the barrel portion. The handle portion includes a handle having a generally cylindrical exterior surface that is engaged by a user to enable the user to grab and swing the training bat. The generally cylindrical exterior surface has a handle diameter sized large enough to substantially inhibit at least one hand of the user from wrapping around the generally cylindrical exterior surface when said at least one hand of the user grabs the generally cylindrical exterior surface of the handle to swing the training bat.

25 Claims, 3 Drawing Sheets

(56) References Cited

U.S. PATENT DOCUMENTS

| | | | | |
|---|---|---|---|---|
| D547,814 | S | 7/2007 | Sims | |
| D667,065 | S | 9/2012 | Cavanagh | |
| 8,771,108 | B2 * | 7/2014 | Auzoux | A63B 60/48 473/553 |
| 9,005,056 | B2 | 4/2015 | Pegnatori | |
| D785,109 | S | 4/2017 | Clark | |
| 10,046,215 | B2 | 8/2018 | Eastman | |
| D830,483 | S | 10/2018 | Jo | |
| 10,456,639 | B2 | 10/2019 | Leinert | |
| 10,478,688 | B1 | 11/2019 | Stevens et al. | |
| D896,902 | S | 9/2020 | Tekerman | |
| 2004/0162169 | A1 | 8/2004 | Gallagher | |
| 2011/0172035 | A1 | 7/2011 | Gregory | |
| 2014/0274496 | A1 | 9/2014 | Sample et al. | |
| 2015/0251069 | A1 | 9/2015 | Teckerman | |
| 2017/0165546 | A1 | 6/2017 | Olds | |
| 2023/0112946 | A1 * | 4/2023 | Ecker | A63B 69/0002 473/457 |
| 2023/0131506 | A1 | 4/2023 | Stelly | |

OTHER PUBLICATIONS

Training Bat Google Search; Google.com; May 23, 2024, 26 pages.
Handle Portion of a Training Bat Google Search; Google.com; May 23, 2024, 5 pages.
U.S. Pat. No. 796184A, Published Aug. 1, 1905, Brown. This U.S. Patent is being reported here as the form will not accept a 6 digit Patent Number. A copy of this U.S. Patent is not being provided.

* cited by examiner

TRAINING BAT

CROSS-REFERENCE TO RELATED APPLICATION

This application claims priority to U.S. Provisional Application No. 63/254,771 filed Oct. 12, 2021, the entirety of which is hereby incorporated by reference.

FIELD

The present disclosure generally relates to a training bat for sports, and more particularly to a baseball and softball training bat.

BACKGROUND

In several sports, including baseball and softball, a person (e.g., batter or hitter) swings a bat at a ball in order to hit the ball into a field of play. Conventional bats have had the same basic design for over a century with a barrel that tappers down to a handle. The person wraps their hands around the handle in order to grip the bat and swing the barrel of the bat at the ball to strike the ball with the barrel and propel the ball into the field of play.

SUMMARY

In one aspect, a training bat comprises a barrel portion and a handle portion connected to the barrel portion. The handle portion includes a handle. The handle has a generally cylindrical exterior surface configured to be engaged by a user to enable the user to grab and swing the training bat. The generally cylindrical exterior surface has a handle diameter. The handle diameter is sized large enough to substantially inhibit at least one hand of the user from wrapping around the generally cylindrical exterior surface when said at least one hand of the user grabs the generally cylindrical exterior surface of the handle to swing the training bat.

In another aspect, a method for improving a swing of a user comprises gripping a generally cylindrical exterior surface of a handle of a training bat with at least one hand of the user. The generally cylindrical exterior surface of the handle has a handle diameter sized large enough to substantially inhibit said at least one hand of the user from wrapping around the generally cylindrical exterior surface when said at least one hand grips the generally cylindrical exterior surface. The method further includes swinging the training bat with said at least one hand.

Other objects and features of the present disclosure will be in part apparent and in part pointed out hereinafter.

BRIEF DESCRIPTION OF THE DRAWINGS

Corresponding reference characters indicate corresponding parts throughout the drawings.

DETAILED DESCRIPTION

The present disclosure relates to a training bat for fixing or optimizing a user's (e.g., batter's or hitter's) bat swing.

The training bat includes an oversized handle, compared to conventional or regulation bats, that alters a user's swing mechanics (compared to conventional bats) to improve or optimize the user's swing and/or fix any flaws with the user's swing.

Figure 1:
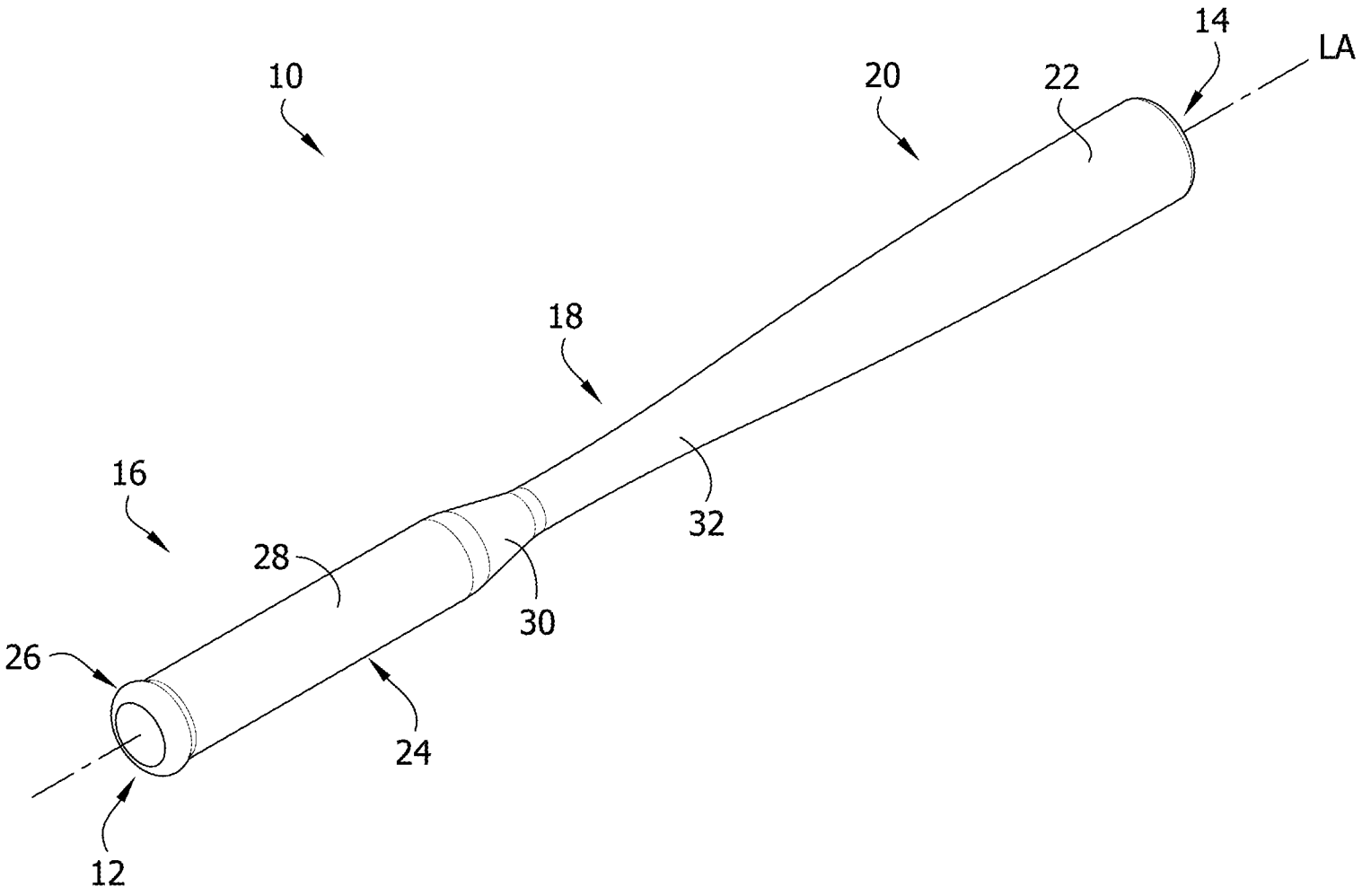
FIG. 1 is a perspective of a training bat according to one embodiment of the present disclosure.
Figure 2:
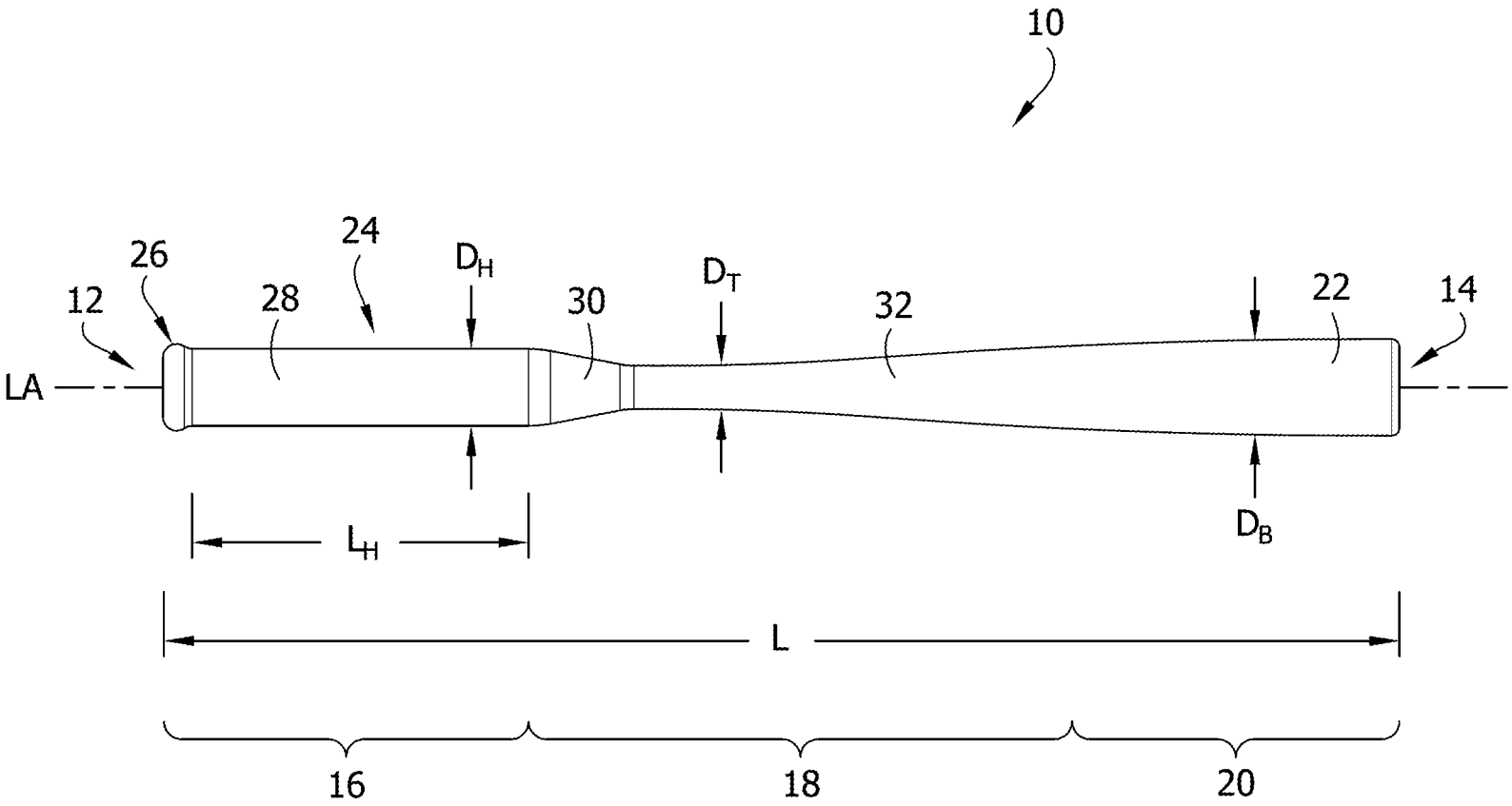
FIG. 2 is a side elevation of the training bat.

Referring to FIGS. 1 and 2, a training bat according to one embodiment of the present disclosure is generally indicated at 10. The training bat 10 is used by a user to improve or optimize the user's swing (e.g., swing mechanics), as described in more detail below. The illustrated training bat 10 is generally for baseball but it is understood the teachings herein regarding the training bat may be applied to bats of other sports as well, such as softball. The training bat 10 can have different sizes and configurations depending on the age of the user the training bat is designed for. For example, the training bat 10 can be a youth-sized training bat generally designed for users age 7 to 12, a junior-sized training bat generally designed for users age 11-14, or an adult-size training bat generally designed for users age 14 and up. The training bat 10 has a proximal end 12, a distal end 14, and a longitudinal axis LA extending between the proximal and distal ends. The training bat 10 has a length L extending between the proximal and distal ends 12, 14. The training bat 10 can come in different lengths L. For example, the length L of the training bat 10 can be about 28 inches, about 29 inches, about 30 inches, about 31 inches, about 32 inches, about 33 inches, about 34 inches, or about 35 inches. The length L of the training bat 10 can depend on the relative age of the user. For example, the youth-size training bat 10 can have a length L of about 28 inches, about 29 inches, about 30 inches or about 31 inches. The junior-size training bat 10 can have a length L of about 30 inches, about 31 inches or about 32 inches. The adult-size training bat 10 can have a length L of about 30 inches, about 31 inches, about 32 inches, about 33 inches, about 34 inches, or about 35 inches. Other lengths of the training bat are within the scope of the present disclosure.

The training bat 10 has a handle portion 16, a transition portion 18 and a barrel portion 20. The barrel portion 20 is configured to strike a ball (not shown). The barrel portion 20 includes a barrel 22 that the user swings at the ball to hit the ball into a field of play. Preferably, the barrel 22 has a size and shape that is generally the same as barrels of conventional or regulation bats (e.g., baseball bats). For example, the barrel 22 may have a barrel diameter $D_B$ of about 2.6 inches (about 67 mm), or more preferably a diameter of about 2.43 inches (about 62 mm). The barrel portion 20 (e.g., the barrel 22) defines the distal end 14 of the training bat 10 and extends proximally from the distal end to a proximal end of the barrel portion.

The handle portion 16 of the training bat 10 is connected to the barrel portion 20. The handle portion 16 includes a handle 24 and a knob 26. The handle 24 includes a generally cylindrical exterior surface 28. The exterior surface 28 is configured to be engaged by a user to enable the user to grab and swing the training bat 10. In particular, at least one hand of the user grips the exterior surface 28 to grab, hold and swing the training bat 10. The exterior surface 28 of the handle 24 has a handle diameter $D_H$. The handle diameter $D_H$ is sized large enough to substantially inhibit the hands of a user (broadly, at least one hand of the user) from wrapping around the exterior surface 28 when the hands of the user grab the exterior surface of the handle 24 to swing the training bat 10. Wrapping a user's hands around the handle of a bat refers to the ability for one or more fingers (e.g., tips thereof) of a user's hand to contact the palm of the same hand when the user is holding the bat and/or the ability for the thumb of the user's hand to contact one or more of the same hand's fingers when the user is holding the bat. Conventional or regulation bats have a handle diameter of about 1 inch. This allows hands of a user to wrap around the conventional or regulation bat by extending their fingers around the handle and engaging the tips of their fingers with the palm of the same hand and/or placing (or having the ability to place) the thumb of the hand in contact with more than one of the fingers of the same hand. As a result, the user can squeeze the conventional or regulation bat with each hand to securely hold the bat as the user swings the bat to hit the ball. By substantially inhibiting the hands of a user from wrapping around the exterior surface 28 of the handle 24 of the training bat 10, the training bat prevents the user from being able to contact the tips of their fingers of one hand with the palm of the same hand when holding the bat. Alternatively or in addition to, by substantially inhibiting the hands of a user from wrapping around the exterior surface 28 of the handle 24 of the training bat 10, the training bat greatly reduces the amount (e.g., about 0.5 inches or less) of overlap the thumb of the user's hand can extend over one or more fingers of the same hand when holding the bat or, more preferably, allows the user to touch the thumb of the hand with only one or even more preferably, none of the fingers of the same hand when holding the bat. As a result, the user is not able to squeeze the handle 24 of the training bat 10 like the handle of a conventional or regulation bat.

The handle diameter $D_H$ is, preferably, equal to or greater than about 1.5 inches. In one embodiment, the handle diameter $D_H$ may be within the inclusive range of about 1.5 inches to about 2.15 inches. Like the length L of the training bat 10, the handle diameter $D_H$ may also be sized based on the age of the user the training bat is designed for. For example, the youth-size training bat 10 can have a handle diameter $D_H$ within the inclusive range of about 1.5 inches to about 2 inches. The junior-size training bat 10 can have a handle diameter $D_H$ within the inclusive range of about 1.75 inches to about 2 inches. The adult-size training bat 10 can have a handle diameter $D_H$ within the inclusive range of about 1.95 inches to about 2.15 inches, or 1.90 inches to about 2.15 inches. Other handle diameters of the training bat are within the scope of the present disclosure.

In the illustrated embodiment, the generally cylindrical exterior surface 28 of the handle 24 is completely cylindrical and the handle diameter $D_H$ of the exterior surface 28 is constant along a handle length $L_H$ of the handle 24. The handle 24 includes a proximal end and a distal end with the handle length $L_H$ extending between the proximal and distal ends of the handle. The exterior surface 28 is smooth and is not interrupted or broken up by any other elements of the training bat. For instance, the exterior surface 28 of the handle 24 is free of any projections, depressions, and the like. The exterior surface 28 defines the entirety of the exterior of the handle 24. The knob 26 is attached to the proximal end of the handle 24 and the transition portion 18 is attached to the distal end of the handle such that the exterior surface 28 is the only exposed and accessible part of the handle for a user to grab. The handle length $L_H$ is sized to permit at least one hand of the user to grab the exterior surface 28. In the illustrated embodiment, the handle length $L_H$ is sized to permit both hands of the user to grab the exterior surface 28 of the handle 24, for example, with one hand gripping the exterior surface of the handle near knob 26 and the other hand positioned distally along the exterior surface, typically in contact with the first hand. In this embodiment, the handle length $L_H$ may be within the inclusive range of about 6 inches to about 10 inches. The handle length $L_H$ can vary within this range depending on the overall length L of the training bat 10 and/or the age of the user the training bat is designed or sized for. Other handle lengths are within the scope of the present disclosure.

The knob 26 of the handle portion 26 is at the proximal end of the handle 24. The knob 26 defines the proximal end 12 of the training bat 10. The knob 26 extends radially outward of the exterior surface 28 of the handle 24. This helps prevent the training bat 10 from slipping out of the user's hands when swinging the training bat. In one embodiment, the knob 26 may extend radially outward of the exterior surface 28 of the handle 24 by about 0.25 inches.

The transition portion 18 of the training bat 10 extends between and interconnects the handle portion 16 to the barrel portion 20. The transition portion 18 has a proximal end attached to the distal end of the handle portion 16 and a distal end attached to the proximal end of the barrel portion 20. The transition portion 20 has a transition portion diameter $D_T$. The transition portion diameter $D_T$ is not constant along the length of the transition portion. As will become apparent, the transition portion diameter $D_T$ is less than the handle diameter $D_H$ at some points along of the transition portion 18 and greater than the handle diameter at other points along the transition portion. The transition portion 20 includes a first or handle tapered section 30 and a second or barrel tapered section 32. The first tapered section 30 extends from the handle 24 (e.g., the distal end of the handle portion 16) toward the barrel portion 20. The first tapered section 30 tapers radially inward, toward the longitudinal axis LA, as the first tapered section extends away from the handle 24 toward the barrel portion 20. The second tapered section 32 extends from the barrel portion 20 (e.g., the proximal end of the barrel portion) toward the handle portion 16. The second tapered section 32 tapers radially inward, toward the longitudinal axis LA, as the second tapered section extends away from the barrel portion 20 toward the handle portion 16. Preferably, the second tapered section 32 has a size and shape that is generally the same as corresponding portion of conventional or regulation bats. The first and second tapered sections 30, 32 are attached or joined together. The distal end of the first tapered section 30 is attached to the proximal end of the second tapered section 32. The first tapered section 30 is shorter in length than the second tapered section 32. Preferably, the length of the first tapered section 30 is significantly shorter than the length of the second tapered section 32. For example, the length of the first tapered section 30 may be about 3 inches or less.

By having a short first tapered section 30 and a barrel 22 and second tapered section 32 that generally have the same size and shape as their respective corresponding portions of conventional or regulation bats, the impact of the enlarged handle 24 on the ball striking performance, weight, weight distribution, feel and visual appearance of the training bat 10 is minimized compared to conventional or regulation bats. For instance, this configuration keeps the striking or distal portion of the training bat 10 (e.g., the barrel 22 and the second tapered section 32) the same as conventional or regulation bats so that the training bat generally produces the same effect when it strikes a ball as a conventional or regulation bat would. Further, reducing the impact on the visual appearance keeps the training bat 10 associated with a particular sport, such as baseball, so that participants of the particular sport (e.g., baseball players) will be able to visually associate the training bat with the sport they play (e.g., will recognize the training bat as a type of baseball bat).

In one embodiment, the training bat 10 (e.g., the handle portion 16, the transition portion 18 and the barrel portion 20 are) is an integral, one-piece component (e.g., of unitary construction). For example, the training bat 10 can be made from a single piece of wood. In other embodiments, the training bat may be formed from multiple components joined together. The training bat 10 can be made of any suitable material, or combinations thereof, such a wood, metal (e.g., aluminum, steel, etc.), plastics, composite materials or the like.

In use during training, a user grabs and swings the training bat 10 like a conventional or regulation bat. The user may use the training bat 10 in generally any training situation a conventional or regulation bat could be used in, such as batting practice, drills, etc. The user picks up the training bat 10 like a conventional or regulation bat. The user positions their hands (broadly, at least one hand) along the handle 24 and then grips the exterior surface 28 of the handle with their hands. The user than swings the training bat 10. Because the exterior surface 28 prevents the user from being able to wrap their hands around the handle 24, the training bat 10 impacts the users swing (e.g., swing mechanics) in several ways as compared to conventional or regulation bats. The user's ability to squeeze the handle 24 of the training bat 10 is significantly reduced compared to conventional or regulation bats, thereby reducing the tension between the user's hands and the training bat during the loading and swinging of the training bat. This reduced tension allows the users body to move more efficiently during the swing. The reduced tension also reduces or eliminates early speed issues when a user begins swinging the training bat 10. These early speed issues are typically a result of the tension between the user's hands and the bat. With the reduced tension, the user obtains a more efficient build-up of speed as the user swings the training bat 10 in order to better max out the speed of the swing of the training bat when the training bat impacts or strikes the ball. The reduced tension also forces the user's big muscles (e.g., the quadriceps, the glutes, the core muscles) to take over the swing of the training bat 10, instead of relying on their forearms, hands, and/or other areas of the arms, therefore allowing the user to maximize their force output during the swing. In addition, because the user is unable to squeeze the handle 24 of the training bat 10 like a conventional or regulation bat, the user can't manipulate the handle as easily as they could the handle of the conventional or regulation bat. This enhances the user's ability to hold their wrists at the desired angles during the swing of the training bat 10 and through contact of the training bat with the ball and inhibits the user from rolling their wrists. This helps optimize the angle of the training bat 10 relative to the path of the ball to reduce the likelihood of ground balls and to help the user hold their form through the training bat's contact with the ball. The user practices with the training bat 10 to develop, refine and reinforce these swing techniques (e.g., swing mechanics) so that the user can apply these swing techniques when using a conventional or regulation bat, such as in a baseball game.

Figure 3:
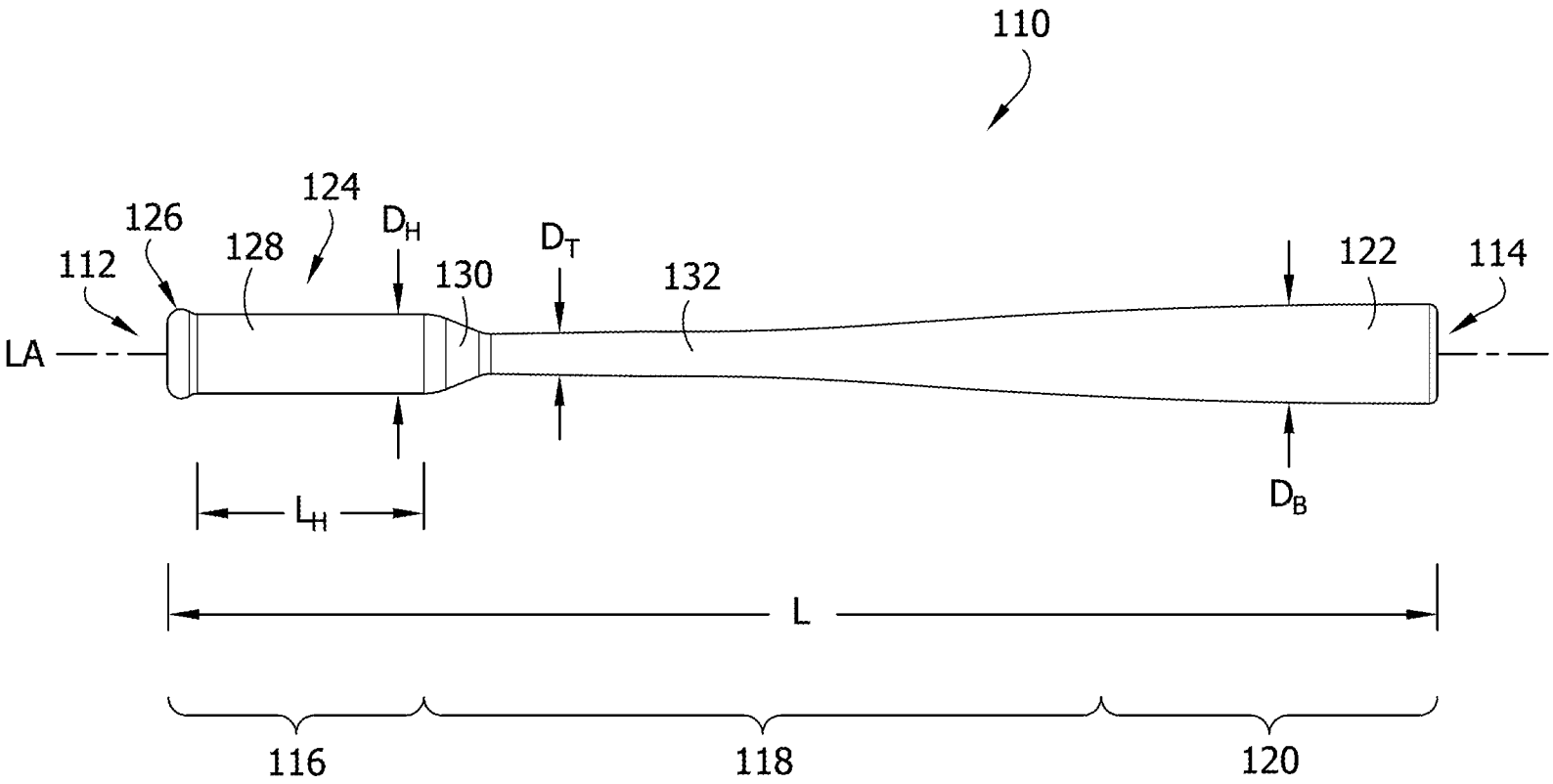
FIG. 3 is a side elevation of a training bat according to another embodiment of the present disclosure.

Referring to FIG. 3, another embodiment of a training bat according to the teachings of the present disclosure is generally indicated at reference numeral 110. The training bat 110 of FIG. 3 is generally analogous to the training bat 10 of FIGS. 1 and 2 and, thus, for ease of comprehension, where similar, analogous or identical parts are used, reference numerals "100" units higher are employed. Accordingly, unless clearly stated or indicated otherwise, the above descriptions regarding the training bat 10 of FIGS. 1 and 2 also apply to the training bat 110 of FIG. 3. For example, the handle 124 of the training bat 110 of FIG. 3 is enlarged like the handle 24 of the training bat 10 of FIGS. 1 and 3.

In this embodiment, the training bat 110 is configured for one handed use or work. The handle length $L_H$ of the handle 124 is sized to permit generally only one hand of the user to grab the exterior surface 128, typically with one hand gripping the exterior surface of the handle near knob 126. In this embodiment, the handle length $L_H$ may be within the inclusive range of about 5 inches to about 7 inches. The handle length $L_H$ can vary within this range depending on the overall length L of the training bat 110 and/or the age of the user the training bat is designed or sized for. Other handle lengths are within the scope of the present disclosure. To make up for the shorter handle length $L_H$ of the handle 124, the training bat 110 of FIG. 3 has a relatively longer transition portion 118 than the transition portion 18 of the training bat 10 of FIGS. 1 and 2. Otherwise, the training bats 10, 110 of FIGS. 1-3 are generally the same and operate in generally the same ways.

It will be appreciated that the person of ordinary skill is readily able to determine the scope of terms of degree such as "about," "substantially," and "generally." For example, when a term of degree is used in relation to a numeric value, the person of ordinary skill understands that the term of degree covers an inclusive range of plus or minus 10% of the numeric value, unless clearly indicated or stated otherwise.

The foregoing descriptions of specific embodiments of the present disclosure are presented for purposes of illustration and description. They are not intended to be exhaustive or to limit the disclosure to the precise forms disclosed, and obviously many modifications and variations are possible in light of the above teaching. The exemplary embodiments were chosen and described to explain the principles of the disclosure and example practical applications, to thereby enable others skilled in the art to best utilize the disclosure and various embodiments with various modifications as are suited to the particular use contemplated.

It will be appreciated that various aspects of the disclosure described herein can be modified without departing from the scope of the appended claims. For example, features may be omitted or have other forms without departing from the scope of the present disclosure.

When introducing elements of the present disclosure or the preferred embodiment(s) thereof, the articles "a", "an", "the", and "said" are intended to mean that there are one or more of the elements. The terms "comprising", "including", and "having" are intended to be inclusive and mean that there may be additional elements other than the listed elements.

As various changes could be made in the above constructions, products, and methods without departing from the scope of the disclosure, it is intended that all matter contained in the above description and shown in the accompanying drawings shall be interpreted as illustrative and not in a limiting sense.

What is claimed is:

1. A training bat comprising:

a barrel portion;

a handle portion connected to the barrel portion and including a handle, the handle having a generally cylindrical exterior surface configured to be engaged by a user to enable the user to grab and swing the training bat, the generally cylindrical exterior surface having a handle diameter, the handle diameter being sized large enough to substantially inhibit at least one hand of the user from wrapping around the generally cylindrical exterior surface when said at least one hand of the user grabs the generally cylindrical exterior surface of the handle to swing the training bat; and a transition portion extending between and interconnecting the handle portion and the barrel portion, the transition portion having a transition portion diameter, the transition portion diameter being less than the handle diameter at some points along of the transition portion, the transition portion including a first tapered section and a second tapered section, the first tapered section extending from the handle toward the barrel portion and tapering radially inward as the first tapered section extends away from the handle toward the barrel portion, and the second tapered section extending from the barrel portion toward the handle portion and tapering radially inward as the second tapered section extends away from the barrel portion toward the handle portion.

2. The training bat of claim 1, wherein the handle diameter is equal to or greater than about 1.5 inches.

3. The training bat of claim 1, wherein the training bat is selected from the group consisting of a youth-sized training bat, a junior-sized training bat, and an adult-sized training bat, the handle diameter of the youth-sized training bat being within the inclusive range of about 1.5 inches to about 2 inches, the handle diameter of the junior-sized training bat being within the inclusive range of about 1.75 inches to about 2 inches, and the handle diameter of the adult-sized training bat being within the inclusive range of about 1.90 inches to about 2.15 inches.

4. The training bat of claim 1, wherein the handle has a proximal end, a distal end, and a handle length extending between the proximal and distal ends, the handle diameter of the generally cylindrical exterior surface of the handle being constant along the handle length.

5. The training bat of claim 4, wherein the handle length is sized to permit generally only one hand of the user to grab the generally cylindrical exterior surface.

6. The training bat of claim 5, wherein the handle length is within the inclusive range of about 5 inches to about 7 inches.

7. The training bat of claim 4, wherein the handle length is sized to permit both hands of the user to grab the generally cylindrical exterior surface.

8. The training bat of claim 7, wherein the handle length is within the inclusive range of about 6 inches to about 10 inches.

9. The training bat of claim 4, wherein the generally cylindrical exterior surface is smooth and comprises a cylindrical exterior surface free of projections and depressions.

10. The training bat of claim 1, wherein the generally cylindrical exterior surface defines the entirety of an exterior of the handle.

11. The training bat of claim 1, wherein the handle portion includes a knob at a proximal end of the handle, the knob extending radially outward of the generally cylindrical exterior surface.

12. The training bat of claim 1, wherein the handle portion and the barrel portion are an integral, one-piece component.

13. The training bat of claim 1, wherein a distal end of the first tapered section is attached to the proximal end of the second tapered section.

14. The training bat of claim 1, wherein the handle portion, the barrel portion and the transition portion are an integral, one-piece component.

15. The training bat of claim 1, wherein the handle diameter of the training bat is within the inclusive range of 1.75 inches to 2 inches.

16. The training bat of claim 1, wherein the handle diameter of the training bat is within the inclusive range of 1.90 inches to 2.15 inches.

17. The training bat of claim 9, wherein the handle has a circular cross-section.

18. A method for improving a swing of a user, the method comprising:

gripping a generally cylindrical exterior surface of a handle of a training bat with at least one hand of the user, the training bat comprising a barrel portion;

a handle portion connected to the barrel portion and including the handle having a generally cylindrical exterior surface, the generally cylindrical exterior surface having a handle diameter; and a transition portion extending between and interconnecting the handle portion and the barrel portion, the transition portion having a transition portion diameter, the transition portion diameter being less than the handle diameter at some points along of the transition portion, the transition portion including a first tapered section and a second tapered section, the first tapered section extending from the handle toward the barrel portion and tapering radially inward as the first tapered section extends away from the handle toward the barrel portion, and the second tapered section extending from the barrel portion toward the handle portion and tapering radially inward as the second tapered section extends away from the barrel portion toward the handle portion, wherein the handle diameter is sized large enough to substantially inhibit said at least one hand of the user from wrapping around the generally cylindrical exterior surface when said at least one hand grips the generally cylindrical exterior surface; and swinging the training bat with said at least one hand.

19. The method of claim 18, wherein said at least one hand comprises both hands of the user.

20. The method of claim 19, wherein the handle has a circular cross-section and has a proximal end, a distal end, and a handle length extending between the proximal and distal ends, the handle diameter of the generally cylindrical exterior surface of the handle being constant along the handle length.

21. A training bat comprising:

a barrel portion;

a handle portion connected to the barrel portion and including a handle, the handle having a circular cross-section and a generally cylindrical exterior surface configured to be engaged by a user to enable the user to grab and swing the training bat and having a handle diameter, the handle having proximal end, a distal end, and a handle length extending between the proximal and distal ends, the handle diameter of the generally cylindrical exterior surface of the handle being constant along the handle length and sized large enough to substantially inhibit at least one hand of the user from wrapping around the generally cylindrical exterior surface when said at least one hand of the user grabs the generally cylindrical exterior surface of the handle to swing the training bat; and a transition portion extending between and interconnecting the handle portion and the barrel portion, the transition portion having a transition portion diameter, the transition portion diameter being less than the handle diameter at some points along of the transition portion, the transition portion including a first tapered section and a second tapered section, the first tapered section extending from the handle toward the barrel portion and tapering radially inward as the first tapered section extends away from the handle toward the barrel portion, and the second tapered section extending from the barrel portion toward the handle portion and tapering radially inward as the second tapered section extends away from the barrel portion toward the handle portion; and wherein the handle portion, the barrel portion and the transition portion are an integral, one-piece component.

22. The training bat of claim 21, wherein the handle diameter of the training bat is sized large enough to prevent the user from being able to contact the tips of their fingers of said at least one hand with the palm of the same hand when said at least one hand of the user grabs the generally cylindrical exterior surface of the handle to swing the training bat.

23. The training bat of claim 21, wherein the handle diameter of the training bat is sized large enough such that the user is able to touch one or none of the fingers of said at least one hand with the thumb of the same hand when said at least one hand of the user grabs the generally cylindrical exterior surface of the handle to swing the training bat.

24. The training bat of claim 21, wherein the handle diameter of the training bat is within the inclusive range of 1.75 inches to 2 inches.

25. The training bat of claim 21, wherein the handle diameter of the training bat is within the inclusive range of 1.90 inches to 2.15.

* * * * *